US009793609B2

(12) United States Patent
Wu et al.

(10) Patent No.: US 9,793,609 B2
(45) Date of Patent: Oct. 17, 2017

(54) SURFACE-MOUNT MULTI-BAND ANTENNA

(71) Applicant: Cirocomm Technology Corp., Tainan (TW)

(72) Inventors: Chia-Tsung Wu, Tainan (TW); Shin-Hui Chou, Tainan (TW)

(73) Assignee: CIROCOMM TECHNOLOGY CORP., Tainan (TW)

( * ) Notice: Subject to any disclaimer, the term of this patent is extended or adjusted under 35 U.S.C. 154(b) by 26 days.

(21) Appl. No.: 15/160,404

(22) Filed: May 20, 2016

(65) Prior Publication Data

US 2017/0170566 A1 Jun. 15, 2017

(30) Foreign Application Priority Data

Dec. 9, 2015 (TW) ..... 104219703 U

(51) Int. Cl.
*H01Q 9/04* (2006.01)
*H01Q 1/48* (2006.01)
*H01Q 5/10* (2015.01)

(52) U.S. Cl.
CPC ..... *H01Q 9/04* (2013.01); *H01Q 1/48* (2013.01); *H01Q 5/10* (2015.01)

(58) Field of Classification Search
CPC .. H01Q 9/04; H01Q 5/10; H01Q 1/38; H01Q 1/241–1/243
USPC ..... 343/700 MS, 702, 846, 895
See application file for complete search history.

(56) References Cited

U.S. PATENT DOCUMENTS 6,600,449 B2 * 7/2003 Onaka ..... H01Q 1/22 343/700 MS
6,683,571 B2 * 1/2004 Ghosh ..... H01Q 1/243 343/700 MS
9,698,481 B2 * 7/2017 Mikata ..... H01Q 1/2291

* cited by examiner

*Primary Examiner* — Dameon E Levi
*Assistant Examiner* — Hasan Islam
(74) *Attorney, Agent, or Firm* — Chun-Ming Shih; HDLS IPR Services

(57) ABSTRACT

A surface-mount multi-band antenna includes a carrier, a first radiator, a second radiator, and a third radiator. The first radiator, the second radiator and the third radiator are respectively arranged on faces of the carrier. The first radiator includes a first rectangular region and a second rectangular region arranged on the bottom face of the carrier. The second radiator includes a third rectangular region and a fourth rectangular region on the bottom face. The second rectangular region has an opened area on the surface of the bottom face to provide coupling effect to increase bandwidth. One end of the fourth rectangular region forms a ground point and has a separation of 0.75 mm with the second rectangular region to provide matching. The fourth rectangular region has a length of 9.9 mm to add one more mode.

6 Claims, 4 Drawing Sheets

SURFACE-MOUNT MULTI-BAND ANTENNA

BACKGROUND OF THE INVENTION

Field of the Invention

The present invention relates to an antenna, especially to a surface-mount multi-band antenna adapted for circuit board with ground metal plane.

Description of Prior Art

As the progress of wireless communication technology, portable electronic products such as laptop computer, smart phone or PDA are developed toward lightweight and compact size. Therefore, the antenna for emitting and receiving electromagnetic wave is needed to size down or change its structure to fit into the compact portable electronic products.

The commercially available multi-band antennas generally adopt Planar Inverted-F Antenna (PIFA) structure. This kind of antenna has simple 2D design and uses PCB technology to directly print copper on PCB to form planar shape multi-band antennas. Alternatively, 3D multi-band antennas can also be formed by pressing metal membrane.

The PIFA structure changes the 2D patterns or geometric shape of metal membrane to achieve multi-band signal transmission and reception. However, the PIFA structure still requires a specific size to have satisfactory signal quality and prevent from out of tuning caused by environment, and the portable electronic product needs a corresponding inner space to accommodate the PIFA structure. It is hard to achieve compact requirement.

SUMMARY OF THE INVENTION

It is object of the present invention to provide a surface-mount multi-band antenna to overcome the problems of prior art. The surface-mount multi-band antenna has metal patterns on a ceramic carrier to form a multi-band antenna suitable for direct surface mount. The surface-mount multi-band antenna has compact size and has fixed contact, ground point and signal feeding points for ensuring the multi-band operation, thus enhancing matching and bandwidth increment.

Accordingly, the present invention to provide a surface-mount multi-band antenna electrically connected to a circuit board. The surface-mount multi-band antenna comprises: a carrier having a front face, a top face, a back face, a bottom face and two side faces; a first radiator comprising a rectangular region and a stripe region of different shapes, the rectangular region and the stripe region arranged on the front face, the top face, the back face, and the bottom face; a second radiator comprising a third rectangular region and a fourth rectangular region respectively arranged on the front face and the bottom face; a third radiator comprising a fifth rectangular region and a sixth rectangular region respectively arranged on the top face and the front face; wherein the first radiator comprises a first rectangular region arranged on one end of the bottom face of the carrier and a second rectangular region arranged on another end of the bottom face of the carrier; the second rectangular region has an opened area on the surface of the bottom face of the carrier such that the second rectangular region has a smaller contact area and a larger contact area separated by the opened area; the smaller contact area is used as signal feeding point and the larger contact area is used as a fixed contact point and for signal radiation; wherein the second radiator has a fourth rectangular region arranged on the bottom face of the carrier and having length of 9.9 mm, the fourth rectangular region is arranged between the first rectangular region and the second rectangular region, the fourth rectangular region has a first end and a second end, the first end is adjacent to the smaller contact area and forms a ground point, a separation between the first end and the smaller contact area is 0.75 mm.

According to one embodiment of the present invention, the first rectangular region has width of 2 mm.

According to one embodiment of the present invention, the first radiator, the second radiator and the third radiator are made from metal material.

According to one embodiment of the present invention, the circuit board has a ground metal plane, a first microstrip line and a second microstrip line, the first microstrip line has a front end with a through hole and a rear end, the front end of the first microstrip line extends on the ground metal plane and has a separation with the ground metal plane, one side of the ground metal plane electrically connects with the second microstrip line, a portion of the second microstrip line is parallel with the rear end of the first microstrip line and the portion has a second separation with the rear end.

According to one embodiment of the present invention, the circuit board has two symmetric fixed contacts for respectively fixing the first rectangular region and the larger contact area.

According to one embodiment of the present invention, the ground point at the first end electrically connects with the second microstrip line and the signal feeding point at the smaller contact area electrically connects with the first microstrip line.

BRIEF DESCRIPTION OF DRAWING

One or more embodiments of the present disclosure are illustrated by way of example and not limitation in the figures of the accompanying drawings, in which like references indicate similar elements. These drawings are not necessarily drawn to scale.

DETAILED DESCRIPTION OF THE INVENTION

Figure 1B:
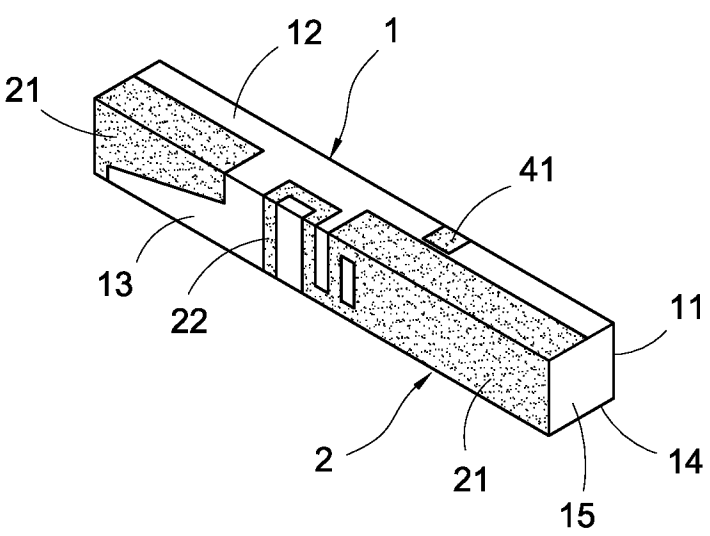
FIGS. 1*a*~1*d* are perspective views of the surface-mount multi-band antenna from different viewing angles.
Figure 1A:
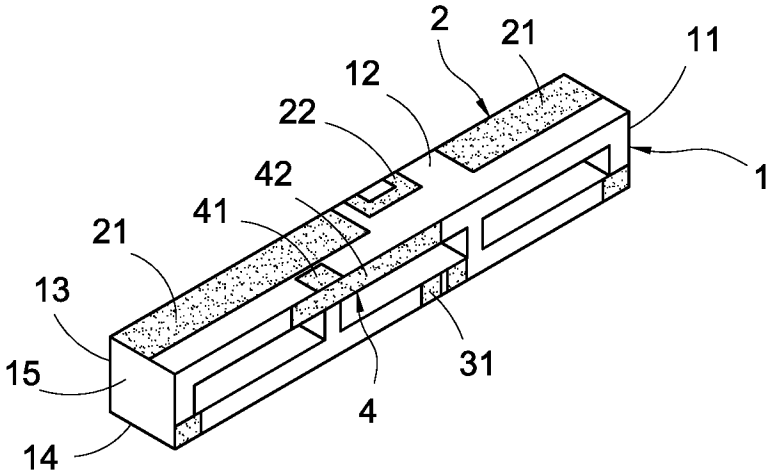
Figure 1D:
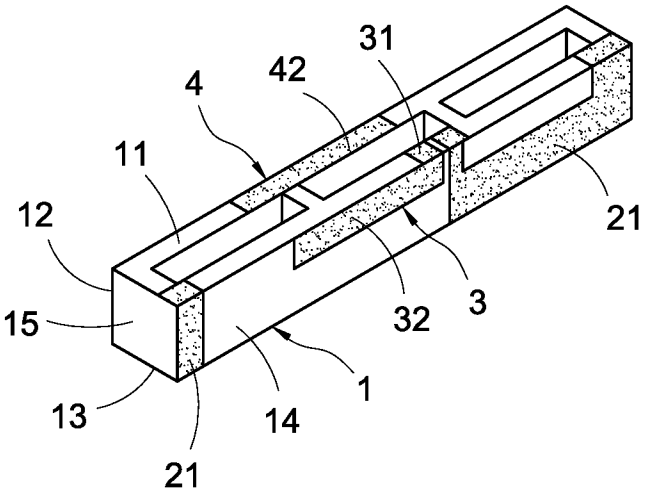
Figure 1C:
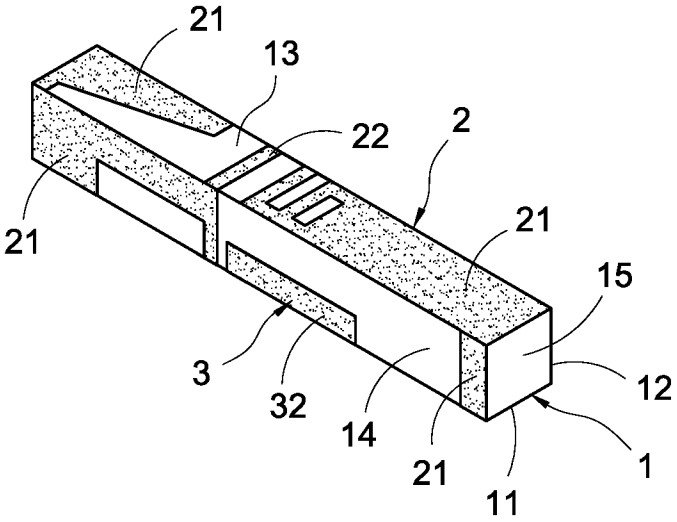

FIGS. 1*a*~1*d* are perspective views of the surface-mount multi-band antenna from different viewing angles. As shown in those figures, the surface-mount multi-band antenna of the present invention comprises a carrier 1, a first radiator 2, a second radiator 3 and a third radiator 4.

The carrier 1 is a rectangular body made of ceramic material of high dielectric constant and has a front face 11, a top face 12, a back face 13, a bottom face 14 and two side faces 15.

The first radiator 2 comprises rectangular region 21 and stripe region 22 of different shapes. The rectangular region 21 and stripe region 22 are arranged on the front face 11, the top face 12, the back face 13, and the bottom face 14. In the shown embodiment, the first radiator 2 is made from metal material.

The second radiator 3 comprises a third rectangular region 31 and a fourth rectangular region 32. The third rectangular region 31 and the fourth rectangular region 32 are arranged on the front face 11 and the bottom face 14. In the shown embodiment, the second radiator 3 is made from metal material.

The third radiator 4 comprises a fifth rectangular region 41 and a sixth rectangular region 42. The fifth rectangular region 41 and the sixth rectangular region 42 are arranged on the front face 11 and the top face 12. In the shown embodiment, the third radiator 4 is made from metal material.

The first radiator 2, the second radiator 3 and the third radiator 4 are arranged on at least two faces of the carrier 1 such that the volume of the surface-mount multi-band antenna can be minimized.

Figure 2:
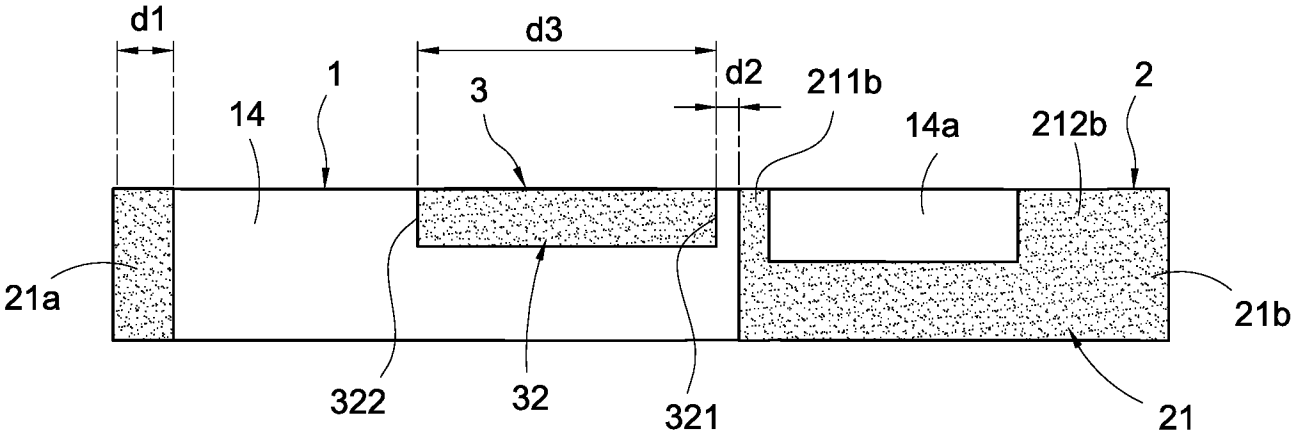
FIG. 2 shows the bottom view of the surface-mount multi-band antenna of the present invention.

FIG. 2 shows the bottom view of the surface-mount multi-band antenna of the present invention. As shown in this figure, the surface-mount multi-band antenna is electrically connected with a circuit board (not shown in FIG. 2) through connecting the portion of the first radiator 2 and the second radiator 3 on the bottom face 14 to the circuit board.

The first radiator 2 has a first rectangular region 21*a* arranged on one end of the bottom face 14 of the carrier 1 and a second rectangular region 21*b* arranged on another end of the bottom face 14 of the carrier 1. The second rectangular region 21*b* has an opened (exposed) area 14*a* on the surface of the bottom face 14 of the carrier 1 such that the second rectangular region 21*b* has a smaller contact area 211*b* and a larger contact area 212*b* (larger than the smaller contact area 211*b*) separated by the opened area 14*a*. The smaller contact area 211*b* is used as signal feeding point and the larger contact area 212*b* is used as a fixed contact point and for signal radiation. The opened area 14*a* on the bottom face 14 of the carrier 1 provides coupling effect to increase bandwidth. In the shown embodiment, the first rectangular region 21*a* preferably has a width d1 of 2 mm.

The fourth rectangular region 32 of the second radiator 3 is arranged on the bottom face 14 of the carrier and is between the first rectangular region 21*a* and the second rectangular region 21*b*. The fourth rectangular region 32 has a first end 321 and a second end 322. The first end 321 is adjacent to the smaller contact area 211*b* and forms a ground point. The separation d2 between the first end 321 and the smaller contact area 211*b* is 0.75 mm such that the signal feeding point and the ground point have a suitable separation for matching. The fourth rectangular region 32 has a predetermined length d3 to have one additional mode for high frequency region; the predetermined length d3 is preferably 9.9 mm.

Figure 3:
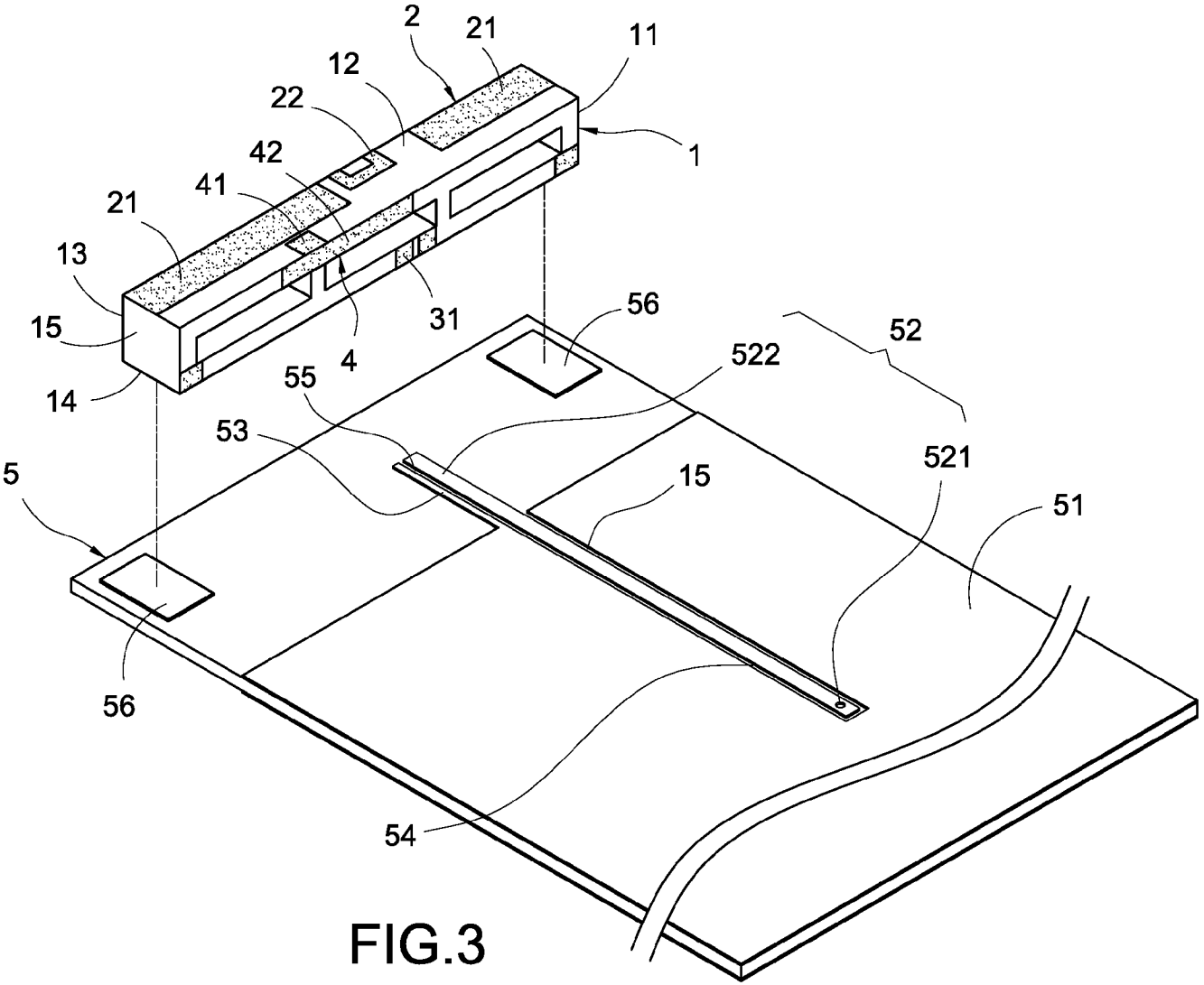
FIG. 3 shows an exploded view of the surface-mount multi-band antenna of the present invention arranged on the circuit board.

FIG. 3 shows an exploded view of the surface-mount multi-band antenna of the present invention arranged on the circuit board. The circuit board 5 has a ground metal plane 51, a first microstrip line 52 and a second microstrip line 53. The first microstrip line 52 has a front end 521 with a through hole 523 and a rear end 522. The front end 521 of the first microstrip line 52 extends on the ground metal plane 51 and has a separation 54 with the ground metal plane 51. One side of the ground metal plane 51 electrically connects with the second microstrip line 53. A portion of the second microstrip line 53 is parallel with the rear end 522 of the first microstrip line 52 and the portion has a second separation 55 with the rear end 522. Moreover, the circuit board has two symmetric fixed contacts 56 for respectively fixing the first rectangular region 21*a* and the larger contact area 212*b* such that the first end 321 (the ground point) electrically connects with the second microstrip line 53 and the smaller contact area 211*b* (the signal feeding point) electrically connects with the first microstrip line 52. The width of the second separation 55 between the second microstrip line 53 and the rear end 522 of the first microstrip line 52 can be used to adjust coupled capacitance such that the ground metal plane 51 has high frequency resonant to increase bandwidth.

Thus, particular embodiments have been described. Other embodiments are within the scope of the following claims. For example, the actions recited in the claims may be performed in a different order and still achieve desirable results.

What is claimed is:

1. A surface-mount multi-band antenna electrically connected to a circuit board and the surface-mount multi-band antenna comprising:

a carrier having a front face, a top face, a back face, a bottom face and two side faces;

a first radiator comprising a rectangular region and a stripe region of different shapes, the rectangular region and the stripe region arranged on the front face, the top face, the back face, and the bottom face;

a second radiator comprising a third rectangular region and a fourth rectangular region respectively arranged on the front face and the bottom face;

a third radiator comprising a fifth rectangular region and a sixth rectangular region respectively arranged on the top face and the front face;

wherein the first radiator comprises a first rectangular region arranged on one end of the bottom face of the carrier and a second rectangular region arranged on another end of the bottom face of the carrier, the second rectangular region has an opened area on the surface of the bottom face of the carrier such that the second rectangular region has a smaller contact area and a larger contact area separated by the opened area, the smaller contact area is used as signal feeding point and the larger contact area is used as a fixed contact point and for signal radiation;

wherein the second radiator has a fourth rectangular region arranged on the bottom face of the carrier and having length of 9.9 mm, the fourth rectangular region is arranged between the first rectangular region and the second rectangular region, the fourth rectangular region has a first end and a second end, the first end is adjacent to the smaller contact area and forms a ground point, a separation between the first end and the smaller contact area is 0.75 mm.

2. The surface-mount multi-band antenna in claim 1, wherein the first rectangular region has width of 2 mm.

3. The surface-mount multi-band antenna in claim 2, wherein the first radiator, the second radiator and the third radiator are made from metal material.

4. The surface-mount multi-band antenna in claim 2, wherein the circuit board has a ground metal plane, a first microstrip line and a second microstrip line, the first microstrip line has a front end with a through hole and a rear end, the front end of the first microstrip line extends on the ground metal plane and has a separation with the ground metal plane, one side of the ground metal plane electrically connects with the second microstrip line, a portion of the second microstrip line is parallel with the rear end of the first microstrip line and the portion has a second separation with the rear end.

5. The surface-mount multi-band antenna in claim 4, wherein the circuit board has two symmetric fixed contacts for respectively fixing the first rectangular region and the larger contact area.

6. The surface-mount multi-band antenna in claim 5, wherein the ground point at the first end electrically connects with the second microstrip line and the signal feeding point at the smaller contact area electrically connects with the first microstrip line.

* * * * *